US006106620A

United States Patent [19]

Morrison et al.

[11] Patent Number: 6,106,620

[45] Date of Patent: Aug. 22, 2000

[54] ELECTRO-MAGNETIC PLUGGING MEANS FOR HOT DIP COATING POT

[75] Inventors: Bruce Robert Morrison, Jamberoo; Raymond Charles Osterberg, Somerville; Richard Payling, Port Kembla; Chris Baharis, Keiraville; James Arthur O'Neill, Figtree; Damien Jinks, Wollongong; Peter James Ellis, Ferntree Gully, all of Australia

[73] Assignee: BHP Steel (JLA) Pty Ltd., Melbourne, Australia

[21] Appl. No.: 08/765,455

[22] PCT Filed: Jul. 26, 1995

[86] PCT No.: PCT/AU95/00458

§ 371 Date: Jul. 28, 1997

§ 102(e) Date: Jul. 28, 1997

[87] PCT Pub. No.: WO96/03533

PCT Pub. Date: Feb. 8, 1996

[51] Int. Cl.[7] ..... B05C 13/00

[52] U.S. Cl. ..... 118/429; 118/419

[58] Field of Search ..... 118/423, 419, 118/420, 429, 405

[56] References Cited

U.S. PATENT DOCUMENTS

| | | | |
|---|---|---|---|
| 3,701,357 | 10/1972 | Granström et al. . | |
| 4,842,170 | 6/1989 | Del Vecchio et al. . | |
| 5,681,527 | 10/1997 | Aoi et al. . | |
| 5,765,730 | 6/1998 | Richter . | |
| 5,827,576 | 10/1998 | Carter et al. | 118/423 |

FOREIGN PATENT DOCUMENTS

| | | |
|---|---|---|
| 0 291 288 | 11/1988 | European Pat. Off. . |
| 2 700 555 | 7/1994 | France . |
| 42 42 380 | 6/1994 | Germany . |
| 43 44 939 | 2/1995 | Germany . |
| 93/18198 | 9/1993 | WIPO . |

OTHER PUBLICATIONS

Database WPI, Section CH, Week 8548, Derwent Publications Ltd, XP002086798 (1985).

Database WPI, Section CH, Week 9303, Derwent Publications Ltd, XP002086799 (1993).

*Primary Examiner*—Brenda A. Lamb

*Attorney, Agent, or Firm*—Arent Fox Kintner Plotkin & Kahn, PLLC

[57] ABSTRACT

A hot dip coating pot (2) having a strip inlet passage (3) and electro-magnetic plugging means to prevent leakage of bath liquid form the pot through that passage, wherein: the plugging means comprises two magnetic field generator (7) disposed one on each side of the passage; each generator projects an oscillating magnetic field into the passage from at least two poles of opposite polarity that are adjacent the passage and spaced apart in the through direction of the passage; the said at least two poles of each generator are respectively in substantial alignment with the corresponding poles of the other in the transverse direction of the passage; the magnetic field projected by the generators have flux patterns which are substantially mirror images with reference to a plane of reflection coinciding with a centre plane of the passage; and both generators operate at a frequency of more than seven kiloHertz. When no strip is present the fields combine and extend transversely of the passage. When a strip is present the fields not only plug the passage but also provide restraining forces to prevent deviation of the strip from its intended pass line.

16 Claims, 6 Drawing Sheets

ELECTRO-MAGNETIC PLUGGING MEANS FOR HOT DIP COATING POT

TECHNICAL FIELD

This invention relates to the pots used to hold baths of molten metal for use in the continuous hot dip coating of metal strip with liquid metal coatings. It was developed for use in the continuous hot dip galvanising of steel strip, wherein the coating metal is essentially zinc. However, it will become apparent that it is applicable to any situation wherein the substrate strip is metal and the coating is a liquid metal, for example, hypereutectic aluminium-zinc alloys and other alloys.

More particularly the invention is directed to electromagnetic plugging means for preventing the leakage of bath liquid from the pot in those instances in which the pot has an opening in it that is below the surface level of the liquid during normal operation.

BACKGROUND ART

In conventional continuous galvanising processes, steel strip, after being cleaned and otherwise conditioned for the adherent acceptance of the coating, is fed from above into a bath of molten zinc or zinc based alloy. The strip passes around a so called "sink roll" submerged in the bath, then emerges from the bath, and passes between coating thickness control devices, which return surplus liquid coating to the bath. The coating is then allowed or caused to solidify and the coated strip is finally coiled for storage, further processing or sale.

The sink roll, being submerged in the bath, operates in a hostile environment and thus is a source of trouble and unreliability unless carefully maintained. Even when adequately maintained, unavoidable wear and tear requires its periodic replacement. Furthermore, dross is sometimes dragged from the surface of the bath by the strip and may become attached to the sink roll and rough alloy growths tend to form on the roll's surface. That dross and those growths damage the strip requiring frequent shut down of the line for removal and replacement of the sink roll with a new or renovated roll. Thus it would be desirable to eliminate the sink roll.

With that desirability in mind, it has been proposed to provide at least one inlet opening in the pot, positioned below the normal operating level of the bath liquid so that a strip to be coated may enter the pot, either horizontally or from below, and depart, either through a similar exit opening or through the mouth of the pot, without need for a change in direction of the strip's pass line within the bath.

It is of course necessary to prevent the outflow of bath liquid through the opening or openings and various electromagnetic plugging means have been proposed for that purpose.

For descriptive convenience the surface of the liquid metal that is supported or otherwise restrained by forces generated by the electro-magnetic plugging means rather than by a solid component of the pot is referred to hereinafter as the "bare" surface of the liquid metal.

Prior proposed electromagnetic plugging means have usually fallen into either of two categories, namely those utilising either poly-phase energising windings or multiple pole electromagnets and switching devices which provide moving magnetic fields passing through the liquid or within the space into which the liquid might otherwise leak, and those which are analogous to electric motors utilising either permanent magnets or DC or single phase electro-magnets in combination with a transverse electric current. All such electro-magnetic plugging devices rely on the interaction of electric currents and magnetic fields, either generated independently or induced one by the other, and the currents are either DC or power frequency and the fields are likewise either steady or oscillating at power frequencies. In both categories of plugging means, the magnetic field and/or the electric current passes through the bath liquid adjacent to the opening to generate restraining forces therein.

Prior proposed electro-magnetic plugging means of the kind discussed above require relatively complex assemblies of components in close association with the liquid metal, thus they all operate in a hot and frequently crowded environment. This leads to design difficulties, limitations on the size and shape of the openings that may be plugged and low operating life expectancies.

Those prior proposed plugging means all suffer from operating deficiencies as well. For example, those which use DC currents flowing between electrodes in contact with the liquid metal, for example to generate a lifting force in the liquid to prevent it falling through a strip inlet opening in the floor of the pot, are inherently unstable. If an adventitious localised downwards projection forms in the bare surface of the liquid metal, then the current density in the projection becomes less than the average current density in the bare surface skin as a whole. Thus the upwards electro-magnetic force on the projection is reduced, and hydrostatic pressure causes it to grow. The more it grows the lower the restoring force becomes, until eventually the projection breaks away from the bare surface as a droplet of bath liquid. After breaking away there is no current through the droplet, the restoring force on it drops to zero, and the droplet falls through the opening. Indeed, in such plugging means any disturbance of the bare surface usually leads to a continuous rain of droplets from it, in that the break away of each droplet may cause sufficient disturbance to initiate the formation of another.

Also, all such prior known proposals that operate at power frequencies, produce flows of liquid within the bath adjacent the opening. Thus the bath is turbulent at the very position where it contacts the strip to be coated, this turbulence seriously degrades the surface quality of the coating on the finished product.

Finally, it should be mentioned that the devices under discussion have or produce powerful magnetic poles adjacent the opening, these interact with ferrous substrate strips tending to attract the strip towards the poles. Any adventitious deviation from the central pass line towards one pole and away from another causes the attraction of the strip towards the one pole to increase and that towards the other to decrease, so producing a deviating force which increases with increasing deviation. Thus the situation is clearly inherently unstable. In the event, successful operation with steel strip requires expensive guide rollers to be positioned closely adjacent to the opening, and an objectionably high tension to be maintained in the strip to prevent deviation, a tension which is not readily attained in practice.

In view of the foregoing and other deficiencies of what may be termed zero or power frequency plugging devices, such devices have not found widespread acceptance or use within the metal coating industry.

One other prior proposal has been suggested, namely the use of a high frequency, oscillating, but spatially stationary electro-magnetic field, positioned so as to exclude the bath liquid from the pot opening. This proposal relies on the fact that such a field generates high frequency eddy currents within the bath. Due to their high frequency the eddy currents flow only in a thin surface layer of the liquid (the so called and well known "skin effect"). The reaction between the surface currents and the field is one of mutual repulsion, and at sufficiently high frequencies the field is effectively excluded from penetrating the liquid. In those circumstances the field behaves as a resilient cushion that may be distorted or compressed by the bare liquid surface but resists penetration of the liquid into the space occupied by the field. The resisting force is perpendicular to the direction of the flux lines of the field and the bare surface of the liquid, and is proportional to the degree of distortion or compression of the field. Thus, unlike lower frequency interactions, the situation is inherently stable, in that an adventitious projection of the liquid surface into the field space produces a localised distortion of the field and an accompanying increased localised resistance to further intrusion.

Furthermore, in the absence of electric currents or electric-fields within the body of the bath liquid there is no turbulence induced in the liquid by the operation of the plugging means.

Thus, high frequency plugging means overcome the major deficiencies of zero or low frequency plugging means, but they are subject to their own inherent limitations.

In particular a high density magnetic field is required if sufficient force is to be generated normal to the bare liquid surface to resist the hydrostatic pressure at the bottom of a liquid metal bath of a depth sufficient to enable a reliable continuous strip coating operation to proceed. This in turn requires high energy generating coils and places a premium on the use of pot and pot opening shapes and dimensions that minimise the extent of the bare liquid area to be supported or otherwise restrained. This at least requires the strip inlet opening to provide only small clearances for the strip passing through it. This, in turn, requires precautions to ensure that the strip does not deviate from the intended pass line to any great extent.

A coating pot provided with a conceptually simple form of high frequency electro-magnetic plugging means is disclosed in Japanese patent No.04-099160 (Nippon Steel). In this instance the "pot" is a hollow, rectangular prismatic cell of silicon carbide some 100 mm wide with a slot some 20 mm wide in its floor. A steel sheet moves upwardly through the slot and through a galvanising bath contained in the cell. The lower part of the cell is surrounded by a solenoid coil that is energised at 20 kHz and has a vertical centre plane coinciding with that of the cell. The slot is set to one side of that centre plane. This is described as causing the lower part of the bath liquid to be pushed towards the centre plane of the cell clear of the slot but leaving the upper part of the bath unaffected. A steel strip to be coated is shown travelling upwardly through the slot and through the upper part of the bath.

Bearing in mind that the 20 kHz field would be effectively excluded from the bath and the strip, it is clear that the field of this device would be asymmetric with regard to the strip in a critical zone immediately above the slot. Indeed because of the shielding effect of the strip there would be very little if any field on the inside of the strip to push the liquid back from the inside of the strip immediately above the slot. This prior proposal would have three major deficiencies, (i) the above mentioned asymmetry would create substantial out of balance lateral forces on the strip requiring special arrangements and objectionably high tension in the strip to reliably maintain the strip out of contact with the walls of the narrow slot, (ii) the deficient field adjacent the inside of the strip would allow liquid to fall through the slot on the inside of the strip, and (iii) the large, bare surface area of liquid would require a large volume, high density field with consequent high power requirements for the generating coil. It might be thought that (i) and (ii) would be overcome by centralising the position of the slot. Indeed that may remove the out of balance force on the strip produced by the plugging field and may prevent leakage when a strip is present in the slot, but would still leave the strip free to move laterally from the pass line. More importantly the naturally densest part of the field within the bore of the coil is substantially vertical and so is not well oriented to provide a vertical restraining force. Thus, in the absence of a strip, restraint would depend on the relatively lower density diverging field at the top end of the solenoid. This would necessitate a very high power coil producing an unnecessarily dense field overall if leakage is to be efficiently prevented.

DISCLOSURE OF THE INVENTION

An object of the present invention is to provide a hot dip coating pot with high frequency electro-magnetic plugging means that overcomes at least the above mentioned deficiency (i) of prior proposed high frequency electro-magnetically plugged pots, and in preferred embodiments alleviates deficiency (ii) thereof.

The invention achieves that object by providing plugging means of the high frequency type which provide stabilising forces on the strip tending to prevent it from deviating from its intended pass line through the plugged opening, and which are more effective to prevent leakage of the liquid metal in the absence of a strip than prior known plugging means of that type.

The invention consists in a hot dip coating pot having a strip inlet passage and electro-magnetic plugging means to prevent leakage of bath liquid from the pot through that passage, wherein:

- the plugging means comprise two magnetic field generators disposed one on each side of the passage;
- each generator projects an oscillating magnetic field into the passage from at least two poles of opposite polarity that are adjacent the passage and spaced apart in the through direction of the passage;
- the said at least two poles of each generator are respectively in substantial alignment with the corresponding poles of the other in the transverse direction of the passage;
- the magnetic fields projected by the generators have flux patterns which are substantially mirror images with reference to a plane of reflection coinciding with a centre plane of the passage; and
- both generators operate at a frequency of more than three kiloHertz.

As a result of their mirror image flux patterns and mutual registration, the projected fields provide identical repulsive forces on opposite sides of a centrally positioned strip, if one be present in the passage. If the strip deviates from the centre of the passage the additional compression of the field on one side and the expansion of the field on the other increases and decreases the repulsive forces respectively to produce a restoring force tending to return the strip to the centre position.

To project a magnetic field, any magnetic field generator necessarily has at least two spaced apart magnetic poles. The poles are necessarily of opposite polarity at any instant and the projected field extends from one to the other along part of an endless flux path. Those poles may be real (solid bodies from which the field emanates) or virtual (a spatial location from which the field emanates). Therefore, to project mirror image fields into the passage in accordance with the invention each generator must have at least two poles of opposite polarity closely adjacent the passage, spaced apart in the through direction of the passage, and in alignment with the corresponding poles of the other generator, as aforesaid.

However in preferred embodiments of the invention there is a further limitation, namely that the polarities of the respectively aligned poles be such as to ensure that when no strip is present in the passage, the projected fields combine, and the combined field extends transversely of the passage from each of the poles of one generator to the corresponding pole of the other generator.

By using two high frequency generators as aforesaid such a change in field pattern is made possible. This change provides the major benefits of the invention. In one pattern the combined field extends transversely of the passage and is ideally positioned to plug the passage when it is open for its full width due to the absence of the strip. In the other pattern the fields extending along the passage on each side of the strip not only respectively plug the narrow passage spaces on each side of the strip but also react with the strip to maintain it central of the inlet passage as a whole, thus enabling a narrow inlet passage to be used along with low tension in the strip.

The invention also extends to a continuous, hot dip, strip galvanising line or like metal coating apparatus, wherein the coating pot is a pot according to the invention.

In conventional coating lines the pot is necessarily large enough to house the sink roll and allow it to be partly or fully submerged in the liquid coating metal. An advantage of the present invention is that the pot may be made very much smaller than has been possible hitherto. Thus the term "pot" as used hereinafter includes small but elongated trough-like containers somewhat different in shape and size from the normal concept of a conventional prior art pot, although fulfilling the same function as before.

BRIEF DESCRIPTION OF THE DRAWINGS.

By way of example, several embodiments of the above described invention are described in more detail hereinafter with reference to the accompanying drawings.

BEST MODE OF CARRYING OUT THE INVENTION

Figure 1:
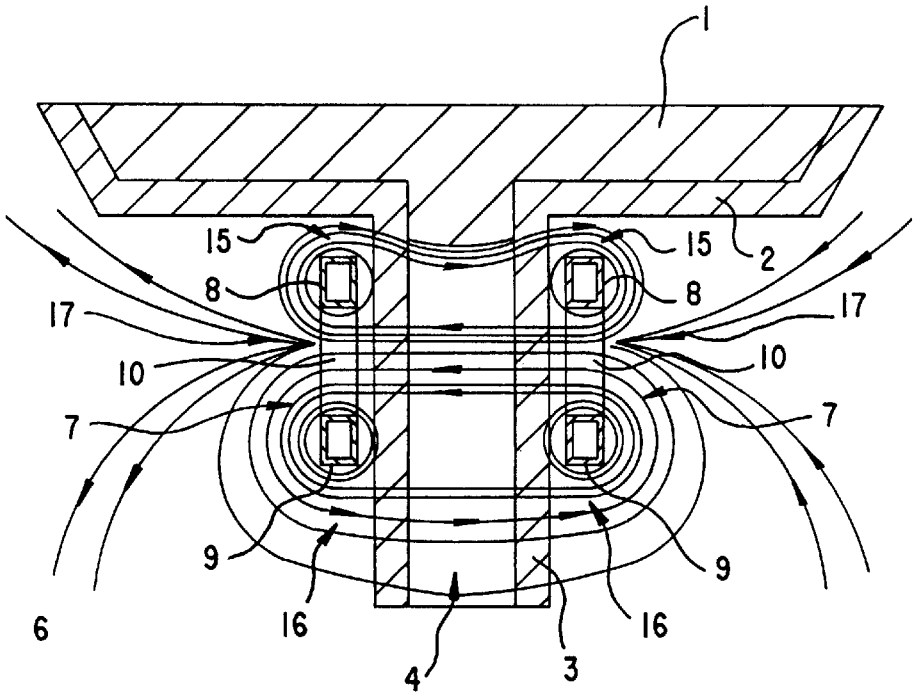
FIG. 1 is a diagrammatic sectional view of a bottom portion of a coating pot according to the invention showing a magnetic field pattern established in the absence of a strip to be coated.
Figure 2:
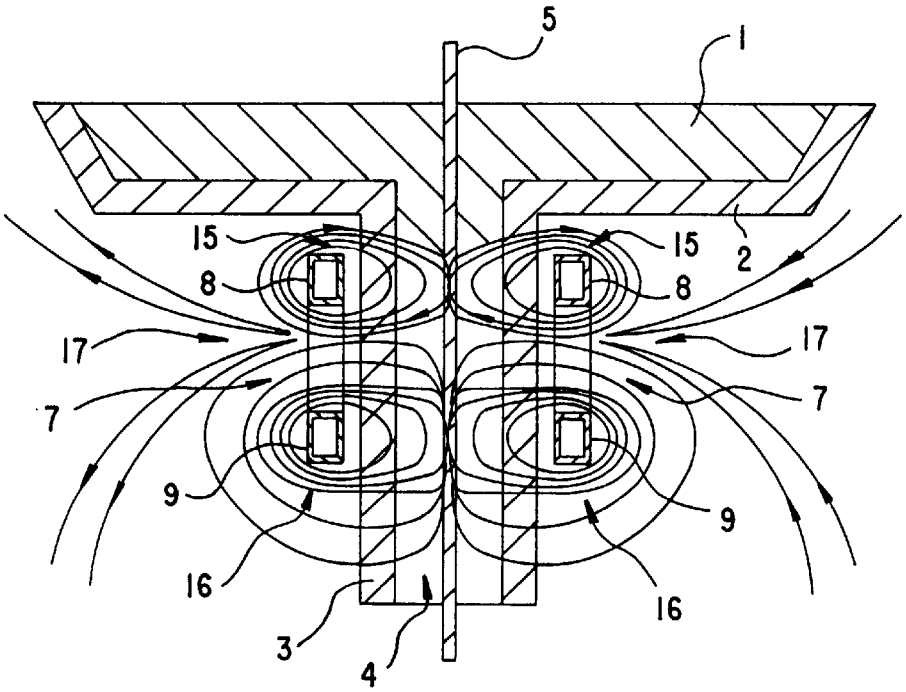
FIG. 2 is a view similar to FIG. 1 showing the subject matter of that figure and the magnetic field pattern established when a strip is present.

As shown in FIGS. 1 and 2, a hot dip coating pot in a continuous strip coating line contains a bath 1 of a molten metallic coating material, for example zinc or an aluminium-zinc alloy. The pot has a floor 2 with a downwardly directed duct 3 of generally rectangular cross-section defining a strip inlet passage 4 providing clearance for the entry into the pot of a metal strip 5 that is to be coated.

The strip 5 is guided by rolls (not shown) to enter the pot from below and travel upwardly through the bath 1. Prior to reaching the passage 4 the strip 5 may be cleaned and otherwise conditioned in conventional manner to receive the coating. Thus a steel strip, for example, would normally be pre-conditioned and fed in a conventional manner from a heating furnace having a controlled reducing atmosphere, through a hood (not shown) likewise containing a reducing or at least inert atmosphere 6, into the passage 4. Having emerged from the bath 1, the strip 5 would be treated, also in a completely conventional manner, to become finished product. Therefore, apart from the provision of rolls to bring the strip to the pot from below and the shape of the mentioned hood, the line equipment downstream and upstream of the coating pot may be conventional in all respects.

The pot may be made from a ceramic or other refractory material, for example a titanium stabilised alumina, silicon carbide or boron nitride.

Figure 3:
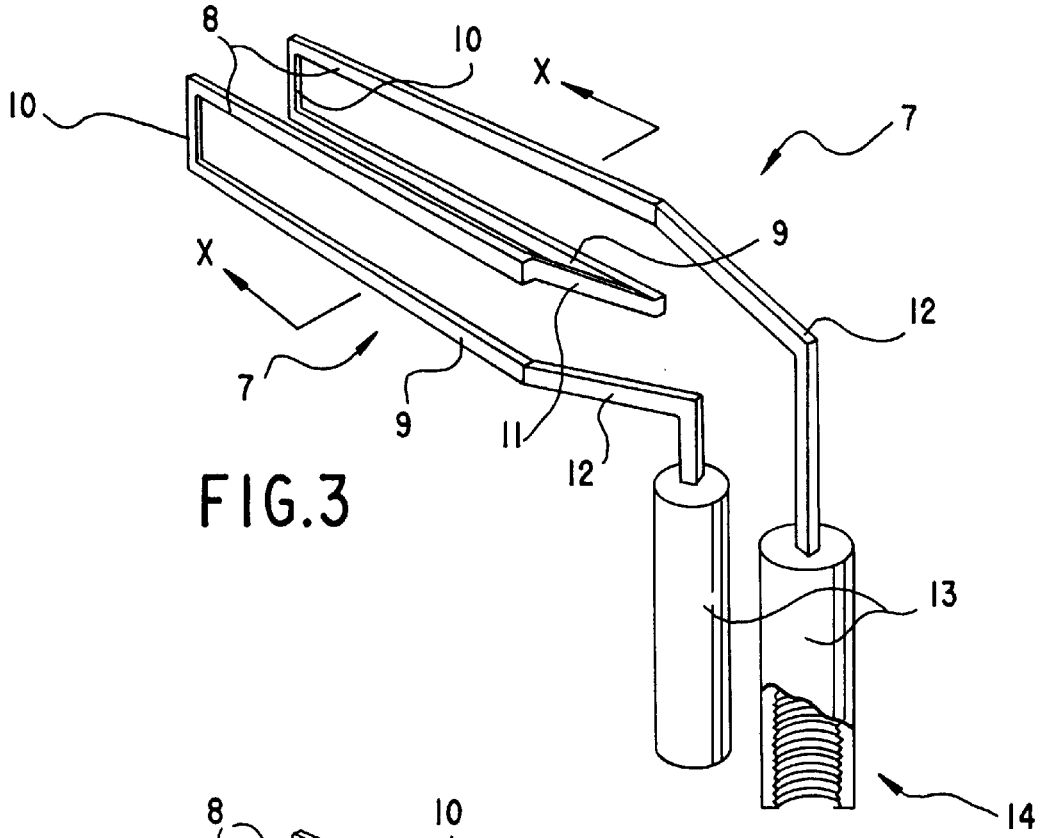
FIG. 3 is a perspective view of a pair of electro-magnetic field generating coils, being components of the pot of FIG. 1.
Figure 4:
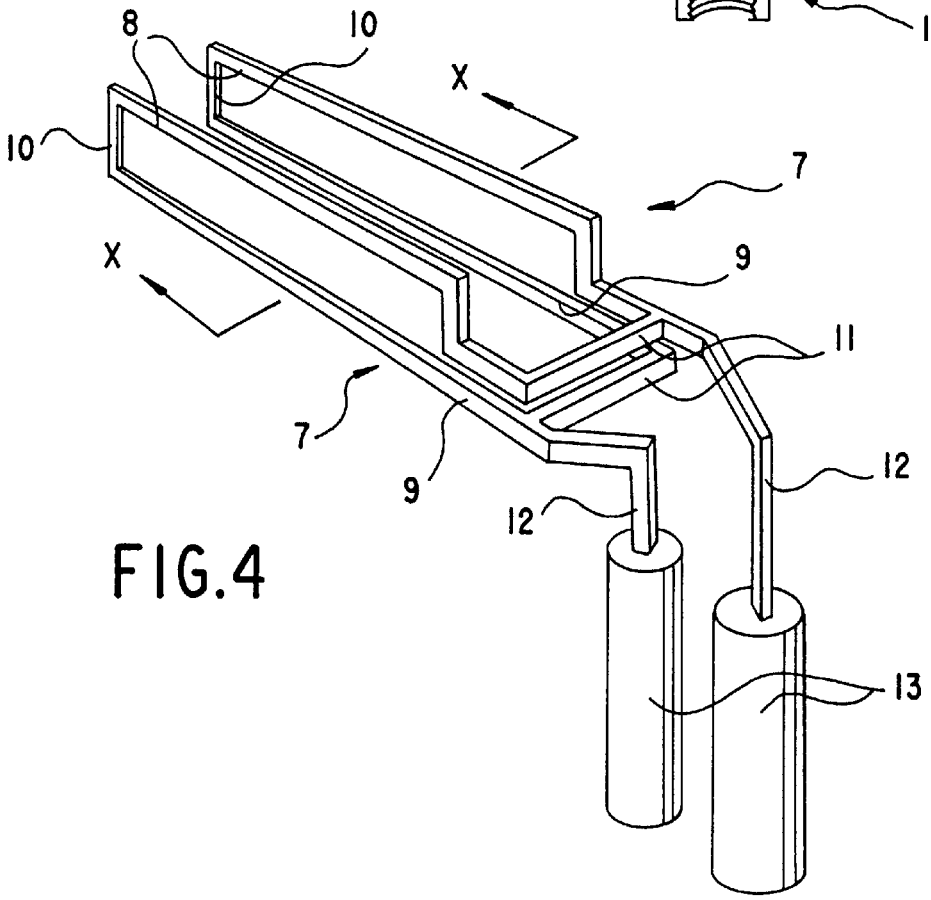
FIG. 4 is a view similar to FIG. 3 of an alternative pair of coils.

Two high frequency magnetic field generators comprising coils 7 are respectively disposed on opposite sides of the duct 3. Those coils may, for example, be optionally one or other of the coils illustrated in FIGS. 3 and 4. They are shown in section in FIGS. 1 and 2, the section being taken on line X—X appearing in FIGS. 3 and 4.

In each instance, each coil 7 is a single turn comprising an upper coil side conductor 8, a lower coil side conductor 9 and a coil end conductor 10. The coils are connected together by interconnecting conductors 11 and are fed by supply conductors 12 extending to terminals 13. In the FIG. 3 arrangement the interconnecting conductors 11 are such that the two coils are in series, whereas in the FIG. 4 arrangement the coils are in parallel.

In both instances the coils preferably extend rigidly as self supporting cantilevers from the terminals 13. To that end the coils may be fabricated from copper tube, preferably tube of non-circular cross section such that each of the coil side conductors 8 and 9 presents a broad flat face towards the adjacent surfaces of the pot and duct. For example, the coils may be fabricated from hollow rectangular section (HRS). The joints between conductors in the coils are preferably brazed with bronze alloy.

The terminals 13 may be lengths of copper tube adapted to be clamped by pipe clamp formations in or on rigid supply bus-bars extending to a high frequency power supply transformer. The terminals may be internally threaded at their lower ends, as indicated at 14 in FIG. 3 where a part of the terminal has been cut away, to receive coolant supply hoses (not shown) whereby coolant may be circulated through the coils 7 while they are in operation.

From the foregoing it will be clear that the instantaneous current direction in the two upper coil side conductors 8 is always the same. Likewise the instantaneous direction in the lower coil side conductors 9 is always the same and always in the opposite direction to that in the upper conductors.

Thus the coils are of the same polarity, and each coil 7 may be regarded as having three virtual poles that are spaced apart in the longitudinal direction of the passage 4, namely the region 15 immediately above the upper coil side 8, the region 16 immediately below the lower coil side 9, and the region 17 at the centre of the coil. The fields from virtual poles 15 and 16 will always be in a common direction (say, at a specific instant, towards the passage 4) and field from virtual pole 17 will be in the opposite direction (at that instant, away from the passage 4), as indicated by arrows on the flux lines shown in FIGS. 1 and 2. Virtual pole 17 may be regarded either as a single pole having twice the strength of each of virtual poles 15 and 16 or as two closely adjacent poles which are the respective counterparts of poles 15 and 16.

In the absence of a strip 5, the close proximity and mutual registration of the corresponding poles of the two generators, which with the simple air cored identical coils of the present embodiment equates with the axial alignment of the coils, ensures that the electro-magnetic fields generated by the coils links both coils. Also, for the same coil current, the transverse component of the field would have a value equal to twice that produced by either coil acting alone.

More importantly, in the absence of a strip, the registration of poles 15 ensures that a portion of the field extends from one to the other transversely of the passage to provide a barrier to the descent of liquid from the bath through the passage. This may be seen in FIG. 1, wherein, although the relevant flux lines are seen to be bowed downwardly where they cross the passage in response to the liquid pressure, the repulsive force on the bare surface of the liquid is still primarily upwards.

In general terms, since the repulsive forces between a high frequency field and the liquid are effective at the interface of the field and the liquid, it is only the field of the poles 15 that is directly effective as a plug, and thus it is only those poles and the pole 17 counterpart of each of them that are necessarily in register in the longitudinal direction of the passage. Thus, in this and other embodiments having simple coils as the field generators, the coils are disposed so that at least their upper coil side conductors are in register with each other in the direction of strip travel, that is to say, assuming the strip travels vertically through the duct the upper coil sides lie in the same horizontal plane. Specifically, the lower coil sides could be more remote from the passage, for example they might lie in the same horizontal plane as the upper sides if desired. In other embodiments the arrangement may be further varied to maximise the field at the lower position of poles 17 and to use the field from these poles for levitation of the liquid.

This complementary polarity and the mutual registration of at least the upper coil sides are significant features of the present embodiment of the invention, in that, in the absence of a strip, it maximises the horizontal component of the generated flux intersecting the duct immediately below the floor 2 of the pot. This in turn maximises the levitating force acting on the bare surface of the liquid metal 1 at the mouth of the duct.

The coils 7 are energised from a preferably constant magnitude, alternating voltage source at a frequency of at least 3 kHz and preferably in excess of 7 kHz.

If the strip 5 is present the field from each generator coil is substantially restricted to that part of the passage and strip on its side of the centre plane of the strip. The generated fields then adopt the mirror image patterns shown in FIG. 2, wherein the field from each pole 15 enters the passage more or less transversely and then turns to extend longitudinally of the passage and strip for a distance before turning again to depart more or less transversely from the passage to pole 17.

The fields projected by poles 15 and 17 then serve to plug the passages on each side of the strip. In this regard it should be noted that the field penetrates the strip, albeit to a very small depth, so that the strip and field together provide for the complete containment for the liquid.

The magnitude of the energising voltage needed to plug the passage in any instance depends on the physical parameters of the installation, (for example, passage width, strip width, number of turns in energising coil etc.) and on the liquid pressure. The last mentioned depends on the density of the coating material and the depth of the bath.

The frequency of the power supply is chosen to produce an optimum balance between conflicting effects. At higher frequencies the so called skin depth of the coil conductors, that is to say the thickness of the surface layer to which the current is largely confined, is reduced and the coil resistance becomes higher. This leads to higher resistive losses. On the other hand, the repulsive force on a conducting body, in this instance the coating liquid, rises as the eddy currents in it become more nearly confined to its surface, that is as the frequency rises. The cross over point between attraction and repulsion of the steel strip occurs at a frequency within the range of from 3 to 7 kHz. Thus frequencies in excess of that up to about 100 kHz are preferable.

In the present embodiment all of the fields from the respective poles, not only that of poles 15 and 17 are projected into the passage and are mirror images of each other, thus the fields projected into the passage by poles 17 and 16 also contribute to the restoring forces preventing the strip pass line from deviating from the desired centre position.

The coils 7 may be effectively in air or other non-magnetisable medium as illustrated. Alternatively the generator coils may be partly externally enclosed in C-sectioned magnetisable shells. Such shells increase the magnetic flux for a given energising current which is advantageous, but also increase the inductance of the coil, which requires a higher energising voltage and is disadvantageous. Thus, if shells are present, a design balance has to be struck to optimise the efficiency of the plugging means.

Figure 5:
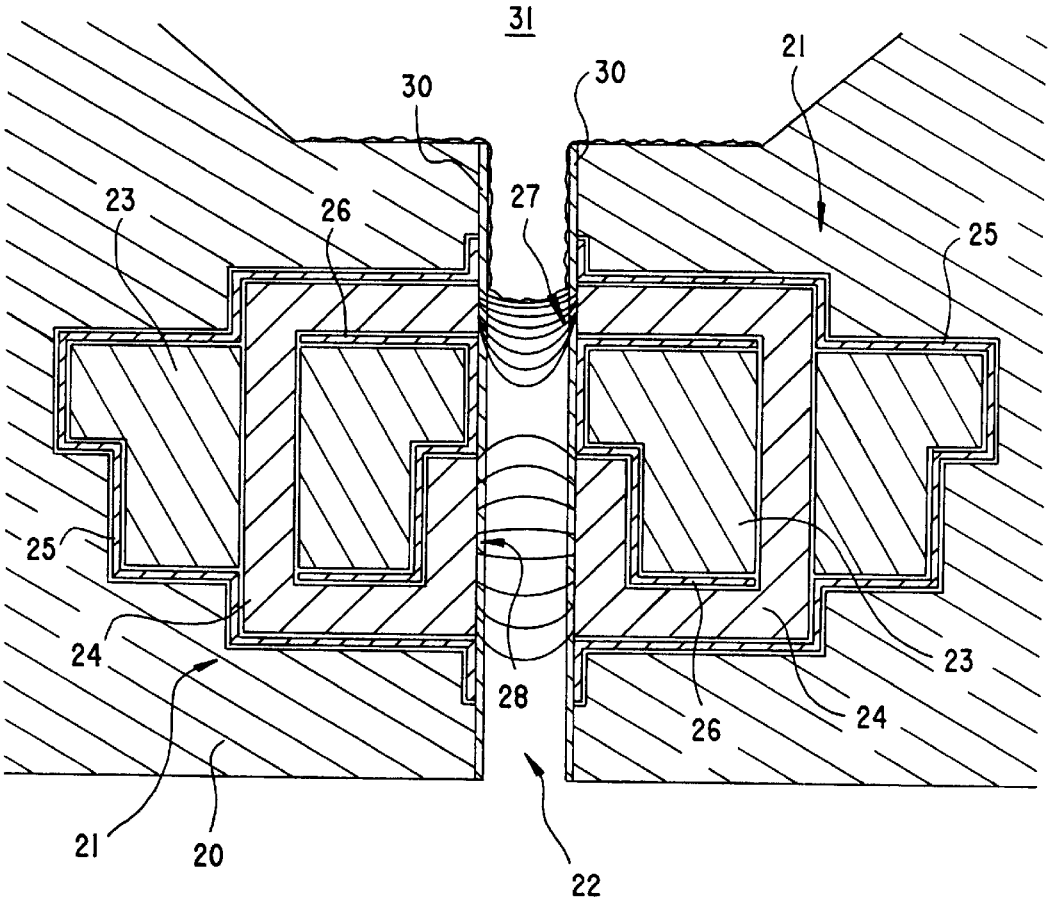
FIG. 5 is a diagrammatic sectional view of a bottom portion of a coating pot according to another embodiment of the invention showing a magnetic field pattern established in the absence of a strip to be coated.
Figure 6:
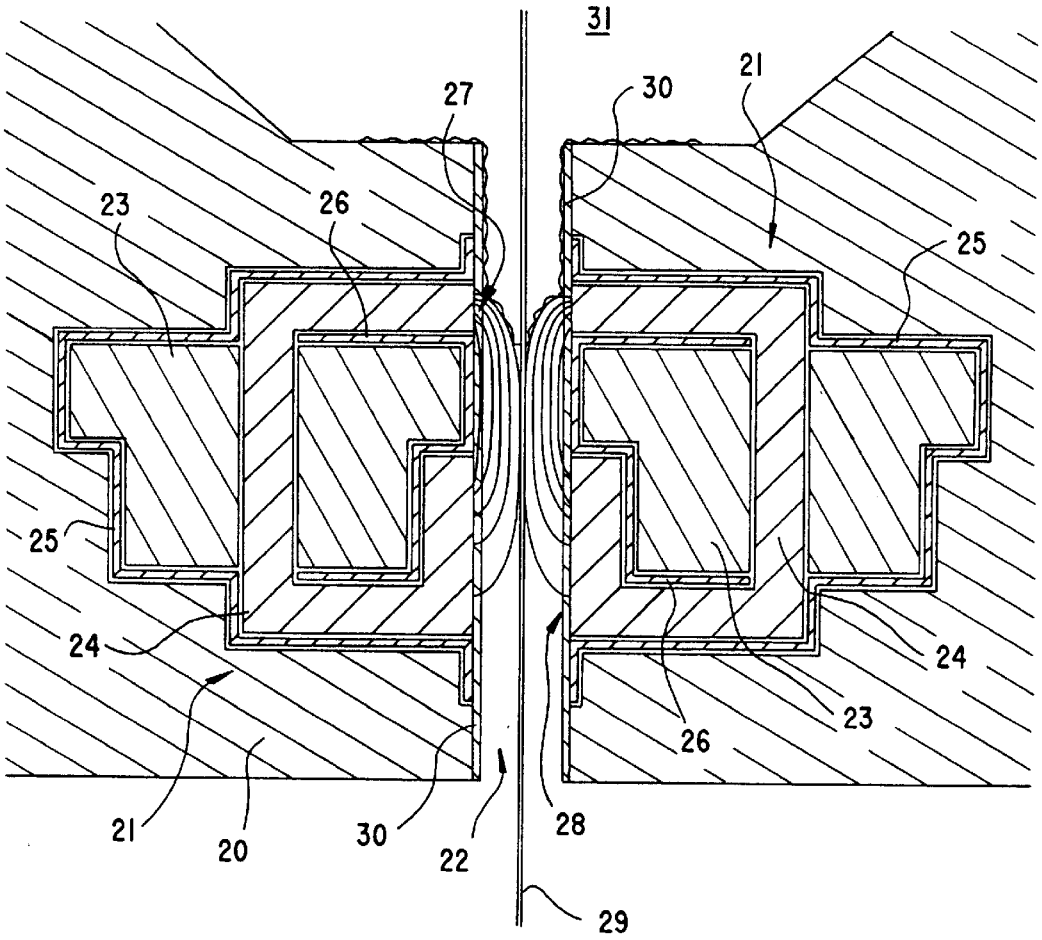
FIG. 6 is a view similar to FIG. 5 showing the subject matter of that figure and the magnetic field pattern established when a strip is present.
Figure 7:
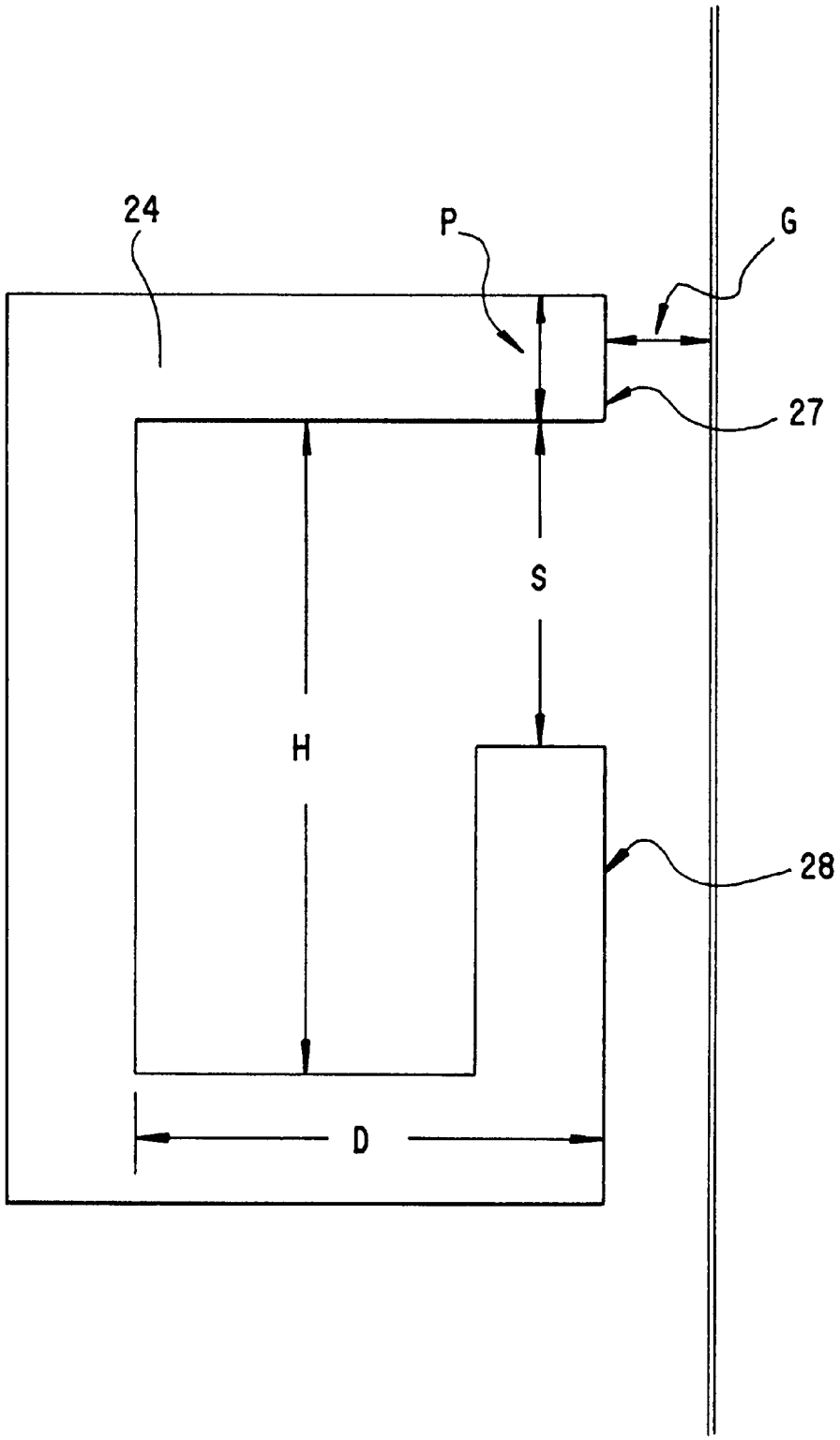
FIG. 7 is a diagrammatic sectional view of a yoke and strip, being components appearing in FIGS. 5 and 6 drawn to a larger scale, showing dimension indicia as referred to elsewhere in the description.

FIGS. 5 to 7 illustrate another preferred embodiment of the invention, wherein each of the field generators is in the nature of an electro-magnet comprising an energising coil wound upon a ferro-magnetic, preferably G shaped, core.

In this instance, the pot may have a floor 20 that is thick enough to enable two, high frequency magnetic field generators 21 to be housed within elongated recesses formed in the confronting faces of the floor 20 that define the pot's strip inlet passage 22.

Each of the generators 21 comprises an energising coil 23 encircling the web of a C- or G-sectioned ferro- or ferr-magnetic core 24 and, preferably, copper or other non-ferrous electrically conductive shields 25 and 26. Those shields constrain the high frequency magnetic field, so that virtually all of the fields generated by the coils 23 emerge from the elongate end faces 27 and 28 of the cores 24. Those faces 27 and 28 are therefore the poles of the field generators 21.

Each of the coils 7 is energised from a preferably common, preferably constant magnitude, alternating voltage source at a frequency in excess of 7 kHz. They are connected to the source so as to produce the preferred polarity, such that when one pole 27 is a north pole the other is a south pole and vice versa.

Under those circumstances a flux pattern as shown in FIG. 5 is produced if and when no strip is present in the passage, whereby the field extending between poles 27 plugs the passage 22, and the field extending between poles 28 plays no direct part in the operation of the pot, other than to complete the flux path.

When a strip 29 is present the flux pattern assumes that shown in FIG. 6, and it will now be clear from the description of the FIG. 1 embodiment that this not only plugs the passage but also centralises the strip in the passage 22.

Each side of the passage 22 is lined with a non-metallic refractory or other heat resistant, insulatory face plate 30, that provides a barrier between the molten metal of the bath 31 and the upper parts of the shields 25 and cores 24.

Various aspects of the design of the components of this embodiment are discussed below.

Each core 24 is made of a low loss material having a high permeability and high saturation magnetisation. For example, high density ferrites, magnetic metallic glass or iron powder may be used. Being of high permeability the core 24 concentrates the magnetic field in the air gap G adjacent the upper pole face 27, preventing excessive "wastage" of the field outside the gap. The yoke preferably has a G shape so that the window occupied by the coil 23 may be made arbitrarily large, independent of the pole separation S, whilst maintaining a reasonably compact cross-sectional shape for the coil.

A large window for the coil allows larger conductors to be used for a given number of turns, this permits lower current densities which, in turn, gives lower resistive power loss in the coil 23. On the other hand increasing the coil size by increasing its conductor size increases the leakage field inside the coil, so that a higher proportion of the field generated does not pass through the upper pole face 27. A balance between these two competing effects has to be reached when determining the size and shape of the core 24.

If the pole separation S is reduced the reluctance of the magnetic path is reduced, so that, for a given number of ampere turns in the coil 23, the total field passed is increased. However, if the pole separation S becomes too small the field may become concentrated in a small region near the poles, and may not penetrate at full strength across the air gap G to the strip 29. In this instance the region of weaker field near the strip may not form an effective plug and so may allow liquid coating metal to escape. As a general rule, the pole separation S should be about, and preferably not less than, three times the air gap G. Thus the spacing between the poles in the through direction of the passage should be within the range of from two to ten times the width of the air gap between the strip being coated and the side of the passage.

Figure 8:
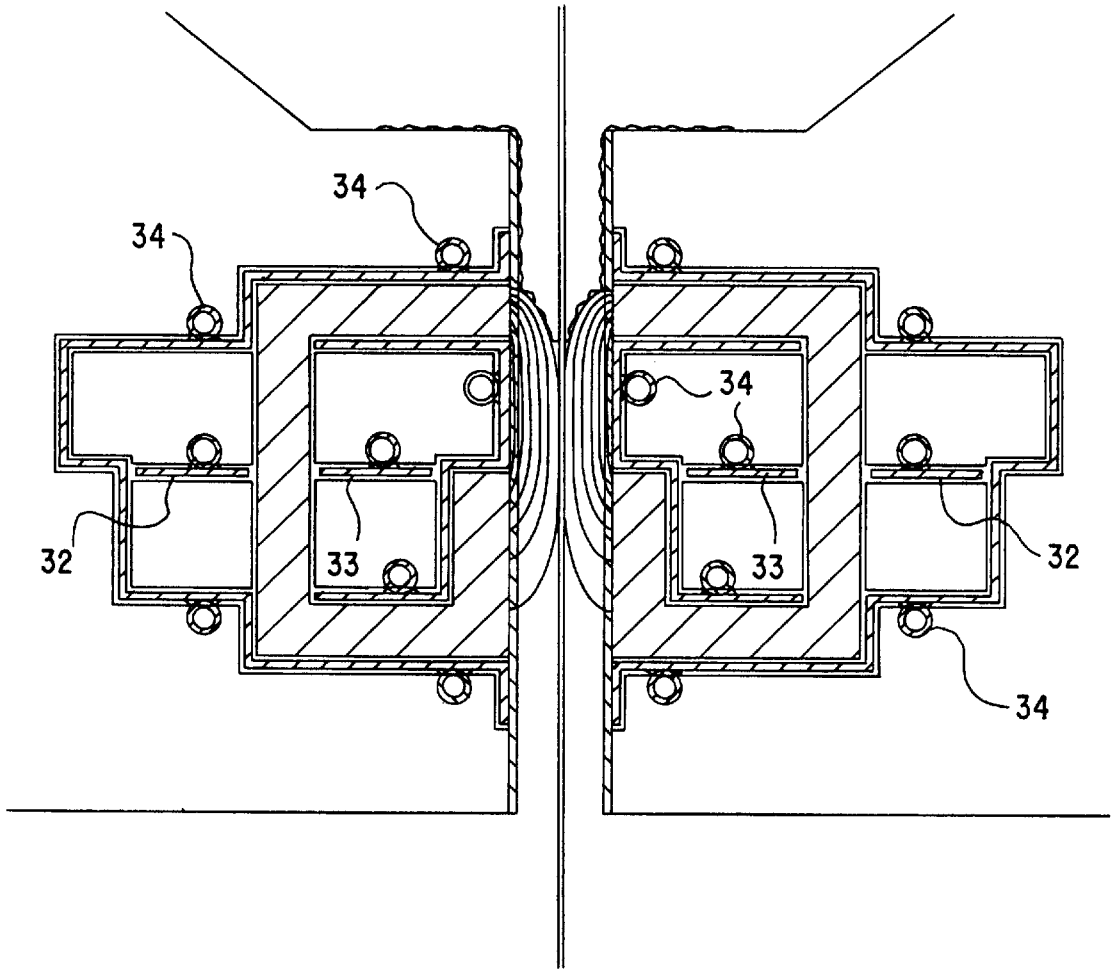
FIG. 8 is a view similar to FIG. 6 oif another embodiment of the invention.

The shields 25 and 26 are made from high conductivity material, for example, copper, aluminium or silver. If the energising coil is very large, additional shielding may be placed between the conductors of the coil to reduce internal flux leakage. Such an embodiment is illustrated by FIG. 8 wherein such additional shields are shown at 32 and 33. Eddy currents will be induced in the shields. This will cause heating in the shields and of course they are in a hot environment. Thus forced cooling of the shields may be required, for example by passing a cooling liquid through tubes brazed or other wise joined to the shields in a thermally conductive manner. The FIG. 8 embodiment includes such tubes referenced 34 in that figure.

In preferred embodiments the number of conductor turns in each coil 23 is small, for example no more than ten, preferably from one to four, depending on the frequency of operation, the geometry of the components and the characteristics of the power supply. As is well known, a multi-filament conductor of the same cross-sectional area as a single filament conductor is more efficient than the single filament conductor at high frequencies. That is to say, other things being equal a multi-filament conductor has a lower power loss than a single filament conductor. This is because high frequency current is largely restricted to the surface skin of the conductor and the multi-filament conductor has a greater surface to cross-sectional area ratio than the single filament conductor. Thus in preferred embodiments each turn of the coil 23 comprises a plurality of tubular conductors in parallel. Those conductors are preferably cooled by means of cooling fluid pumped through their bores.

For the reasons elaborated in relation to the first described embodiment the field frequency is preferably within the range of from 7 kHz to 100 kHz although even higher frequencies are quite feasible.

By way of example, the details of an appropriate design for a galvanising pot furnished with plugging means according to the last described embodiment of the invention and holding a zinc or aluminium-zinc bath with a nominal depth of 0.5 metres are indicated below:

| PARAMETER | VALUE |
|---|---|
| Air gap (G) | 10 mm |
| Number of turns in coil | 1 |
| Number of tubular conductors in parallel in each turn | 126 |
| Outside diameter of each tubular conductor | 12.5 mm |
| Frequency of excitation | 20 kHz |
| Length of upper pole face (P) | 30 mm |
| Pole separation (S) | 80 mm |
| Window height (H) | 150 mm |
| Yoke depth (D) | 150 mm |
| Flux density in air gap* | 0.414 T (peak) |
| Energising current* | 33,000 A (rms) |
| Applied voltage* | 2161 V (rms) |
| Power loss in coil* | 20 kW |
| Plugging pressure (ideal)* | 33.1 kPa |
| Head of liquid zinc (ideal)* | 488 mm |

*Calculated values.

What is claimed is:

1. A hot dip coating apparatus comprising:

a pot for containing a bath of molten metal, duct means defining an elongate strip inlet passage having a longitudinal direction extending downwardly from an opening in a floor surface of the pot, the passage and the opening being dimensioned so that a metal strip to be coated may move upwardly through the passage and the opening into the bath without contacting the apparatus or the duct means, and electro-magnetic plugging means to prevent leakage of bath fluid from the pot through the passage, wherein:

the plugging means comprise two magnetic field generators disposed one on each side of the duct means;

each generator projects an oscillating magnetic field into the passage from at least two poles of opposite polarity that are adjacent the passage and spaced apart in said longitudinal direction;

said at least two poles of each generator are respectively directed towards and in substantial alignment with the corresponding poles of the other generator in transverse directions substantially perpendicular to said longitudinal direction to form two pairs of mutually aligned poles;

the magnetic fields projected by the generators extend along flux paths which are substantially mirror images about a longitudinal center plane of the passage;

both generators operate at a frequency of more than three kiloHertz; and the poles of each mutually aligned pair of poles are of opposite instantaneous polarity, whereby;

in use in the absence of an intervening strip to be coated, the projected magnetic fields extend across the passage between the poles of each said mutually aligned pair of poles and, in use in the presence of an intervening strip to be coated, the projected magnetic fields extend longitudinally of the passage between the at least two poles of each generator without crossing said intervening strip.

2. A hot dip coating apparatus according to claim 1 wherein the strip inlet passage is of rectangular cross-section.

3. A hot dip coating apparatus according to claim 2 wherein the apparatus is of a refractory material.

4. A hot dip coating apparatus according to claim 3 wherein said refractory material is any one of titanium stabilised alumina, silicon carbide and boron nitride.

5. A hot dip coating apparatus according to claim 1 wherein each generator comprises a coil of a conductor extending rigidly as a self supporting cantilever from two end terminals.

6. A hot dip coating apparatus according to claim 5 wherein said coil is a single turn coil.

7. A hot dip coating apparatus according to claim 5 wherein said conductor is a tube and said terminals are adapted for connection to a source of coolant to provide for coolant flow along and within the tube.

8. A hot dip coating apparatus according to claim 1 wherein each of the field generators comprises an energising coil wound upon a magnetic core having end faces directed towards said passage, which end faces constitute said poles of the generator.

9. A hot dip coating apparatus according to claim 8 wherein said core is G shaped, whereby one end face is smaller than the other.

10. A hot dip coating apparatus according to claim 9 wherein said generator is furnished with non-ferrous electrically conductive shields adapted to constrain magnetic fields and positioned to increase the proportion of the total field generated by the energising coil emerging from the end faces of the core.

11. A hot dip coating apparatus according to claim 10 wherein said shields are force cooled.

12. A hot dip coating apparatus according to claim 8 wherein each side of the passage is lined with a non-metallic refractory, heat resistant, insulatory face plate, that provides a barrier between the molten metal of the bath and the generators.

13. A hot dip coating apparatus according to claim 8 wherein the core is made of a low loss material having a high permeability and high saturation magnetisation.

14. A hot dip coating apparatus according to claim 13 wherein said material is any one of a high density ferrite, magnetic metallic glass and iron powder.

15. A hot dip coating apparatus according to claim 8 wherein each energising coil is a coil of multi-filament conductor of no more than ten turns.

16. A hot dip coating apparatus according to claim 1 wherein said frequency is within the range of from 7 kHz to 100 kHz.

* * * * *